US005871431A

United States Patent [19]

Vangeli

[11] Patent Number: 5,871,431

[45] Date of Patent: Feb. 16, 1999

[54] PLANT FOR MANUFACTURING CARDBOARD CONTAINERS AND THE MANUFACTURING METHOD FOR SAID CONTAINERS

[75] Inventor: Carlo Vangeli, Guanzate, Italy

[73] Assignee: Vara S.r.l., Como, Italy

[21] Appl. No.: 733,280

[22] Filed: Oct. 17, 1996

[30] Foreign Application Priority Data

Oct. 20, 1995 [IT] Italy ..... MI94A2171

[51] Int. Cl.[6] ..... B31B 1/46

[52] U.S. Cl. ..... 493/169; 53/329.4; 53/456; 53/478; 53/563; 493/104

[58] Field of Search ..... 493/167–171, 493/183, 104; 53/452, 456, 563, 564, 478, 329.4

[56] References Cited

U.S. PATENT DOCUMENTS

| | | | |
|---|---|---|---|
| 3,345,795 | 10/1967 | Anderson | 53/452 |
| 3,995,539 | 12/1976 | Wallin | 493/169 |
| 4,289,491 | 9/1981 | Collura et al. . | |
| 4,485,610 | 12/1984 | Gillery | 53/452 |
| 4,549,876 | 10/1985 | Baker et al. . | |
| 4,626,234 | 12/1986 | Oxborrow | 493/167 |
| 4,832,676 | 5/1989 | Johns | 493/171 |
| 5,024,641 | 6/1991 | Boisseau | 493/171 |
| 5,496,250 | 3/1996 | Fiedler | 493/169 |

FOREIGN PATENT DOCUMENTS

| | | |
|---|---|---|
| 0161800 | 11/1985 | European Pat. Off. . |
| 9401595 | 3/1994 | Germany . |

OTHER PUBLICATIONS

European Search Report, The Hague, Nov. 17, 1997, Examiner Pipping, L. Abstract, EPA 96201631.7.

*Primary Examiner*—Jack W. Lavinder
*Attorney, Agent, or Firm*—Hedman, Gibson & Costigan, P.C.

[57] ABSTRACT

A plant for manufacturing containers, for example for food use, consisting of a number of compartments equal to or greater than one, which comprises a station for the initial shaping of a container starting from a relative punched cardboard blank, a station for the final shaping of the edges of the container already shaped by said initial shaping station and a station for closing the container with a lid, in which each blank is fed by feed means to the initial shaping station, means for transferring the shaped container being provided between the stations, the container having a number of compartments greater than one, the initial shaping station comprising a forming head assembly consisting of a number of forming heads equal to the number of compartments into which the container is divided, counteracting means cooperating with the forming heads to deform the blank, and means for discharging the thus shaped container, the forming heads being movable at least one relative to the other and the counteracting means also being movable at least one relative to the others.

18 Claims, 14 Drawing Sheets

PLANT FOR MANUFACTURING CARDBOARD CONTAINERS AND THE MANUFACTURING METHOD FOR SAID CONTAINERS

This invention relates to a plant for manufacturing containers for food use.

In particular, the containers concerned are containers having one or more compartments for containing the food product or products and, on the upper face of the container, a simple or hermetic lid removable either totally or partially. For example, this category includes containers used for fresh, frozen or deep-frozen precooked foods to be heated to a suitable temperature by conventional or microwave ovens. The product, in solid, semi-solid or liquid form, is loaded into the compartment or compartments with which they are provided.

In the food industry, currently used food containers of the aforesaid type are formed from thermosetting plastics by a conventional moulding process, for example thermoforming. Recycling such material is particularly difficult and problematic, and moreover very costly and ecologically disadvantageous. In addition, when placed in a hot environment (such as an oven) they may release harmful gas, so being unsuitable for food use.

In attempting to make these containers more easily disposable and salvageable, and hence lower their cost, it has recently emerged that cardboard can be used as starting material for manufacturing said containers.

The present invention provides a plant for manufacturing cardboard food containers of the aforesaid type.

Such a plant would be advantageously used for example inserted into a line for loading and possibly specially treating the food product to be packaged. This line could also comprise weighing, metering, cooling or heating elements, elements for mixing the various food components, and so on according to requirements.

The present invention also relates to a method for manufacturing said containers by the plant of the present invention.

The plant of the present invention forms cardboard containers with one or more compartments. If the number of container compartments is to be greater than one, the number is preferably two or three. In all cases the starting point in the manufacture of an individual container is a punched blank having the required profile for forming the base surface of the container, its lateral surfaces, the vertical partitioning surfaces between the various containers into which the container may be divided, and the corner sutures (typically of triangular shape). The blank is produced in a suitable punching section of conventional type.

The present invention in particular provides a plant for manufacturing containers, for example for food use, according to claim 1.

Optionally, a thermowelding station can be inserted between said initial shaping station and said final shaping station.

That embodiment of the plant according to the present invention in which a thermowelding station is inserted is used for manufacturing containers in which the number of compartments is greater than one. In this case it is necessary to weld together the adjacent partitioning walls between two compartments so that the container can no longer open in the manner of a bellows along its longitudinal axis.

In a first embodiment of the plant according to the present invention, the initial shaping station comprises a assembly of forming heads comprising as many forming heads as the compartments into which the container is divided, counteracting means cooperating with said forming heads for deforming the blank, and means for discharging the container shaped in this manner.

In particular, according to a preferred embodiment of the plant of the present invention, the feed means for the cardboard blanks consist of one or more suckers which withdraw an individual blank from a pile of blanks and deposit it on the upper surface of said assembly of said forming heads.

In a further embodiment, the blanks to be shaped are fed on a conveyor belt the end of which faces the aforesaid shaping zone. The conveyor belt discharges them at regular intervals, controlled on the basis of the shaping rate of the initial shaping station. The initial shaping station is equipped with a series of devices able to blow hot compressed air into the corner sutures of the container while the container is progressively deformed starting from the blank by means of the forming heads. In this respect the corner sutures consist essentially of cardboard flaps (advantageously said flaps are of triangular shape) which are folded over so that when the container has been formed they are pressed against the container walls. By blowing hot air onto said flaps during their folding, the polymer layer coating the cardboard becomes hot and melts both on the flap and on the container wall. The two hot, molten layers then become welded together on subsequent cooling once the air flow is interrupted.

The thermowelding station operates on the same principle. This station is fed with an already shaped blank provided for a multi-compartment container, in which the vertical partitioning walls which bound each compartment are however still free to move relative to each other. To eliminate this degree of freedom, the two walls are welded together by thermal effect by means of a hot air flow and the clamping action of two grippers. The heat melts the polymer or varnish layer previously applied during the cardboard manufacture to coat the cardboard, so that on subsequent cooling (on withdrawing the grippers) the two adjacent walls become strongly welded together.

In the final shaping station the container edges, which leave the initial shaping station vertically aligned with the container walls, and lowered and made substantially horizontal. When the edges are horizontal, the container lid is rested on them and thermowelded by a pair of elements which apply sufficient pressure.

The container is then filled between the initial shaping station (or the thermowelding shaping station if provided) and the final shaping station.

If the container is of single compartment type, the plant of the present invention comprises an initial shaping station in which only one forming head is present, interacting with the single base surface of the container. The thermowelding station is not required, whereas the rest of the plant remains substantially unchanged.

The plant of the invention can be used for containers of different shapes and sizes, by adjusting in a simple and often automatic manner the dimensions of the devices of which the plant is composed or, where necessary, quickly replacing parts and elements of the devices to adapt them to the different containers.

As the constituent material of the container is cardboard, once it has been used it can be easily salvaged by conventional salvaging systems. This avoids the ecological and disposal problems connected with the use of containers of thermosetting plastics. Specifically, the containers manufactured by the plant of the present invention are suitable for food use, and can advantageously contain precooked, semi-cooked, raw and other foods.

Conventional cooling, freezing, deep-freezing, packing, labelling and other equipment can be provided downstream of the plant of the present invention.

In a preferred embodiment, the entire plant of the present invention can be controlled by a single central system which automates all operations and coordinates them with time. In this manner every stage in the manufacture of the cardboard container and its filling, together with possible supplementary operations, is controlled by a single controller. All operations are synchronized and any abnormalities are quickly noticed by suitable control and safety devices. Signals from these control and safety devices continuously reach the control centre, which on the basis of these can decide whether to halt the plant, eliminate the defective container or containers, or take further action decided on case by case.

The present invention also provides a method for forming a single-compartment cardboard container starting from a punched blank in which the blank is firstly shaped with its edges vertical, the edges are then folded horizontally, a lid is rested on the container with its edges folded, and the lid is then welded to all the folded edges of the container, all the formation steps being carried out in a plant according to the present invention.

The present invention also provides a method for forming a cardboard container with more than one compartment starting from a punched blank in which the blank is firstly shaped with its edges vertical, the walls bounding two adjacent compartments are then thermowelded together, the edges are then folded horizontally, a lid is rested on the container with its edges folded, and the lid is then welded to all the folded edges of the container, all the formation steps being carried out in a plant according to the present invention.

Further aspects and advantages of the present invention will be more apparent from the description given hereinafter by way of non-limiting example. The description refers to the accompanying drawings, in which.

Figure 1:
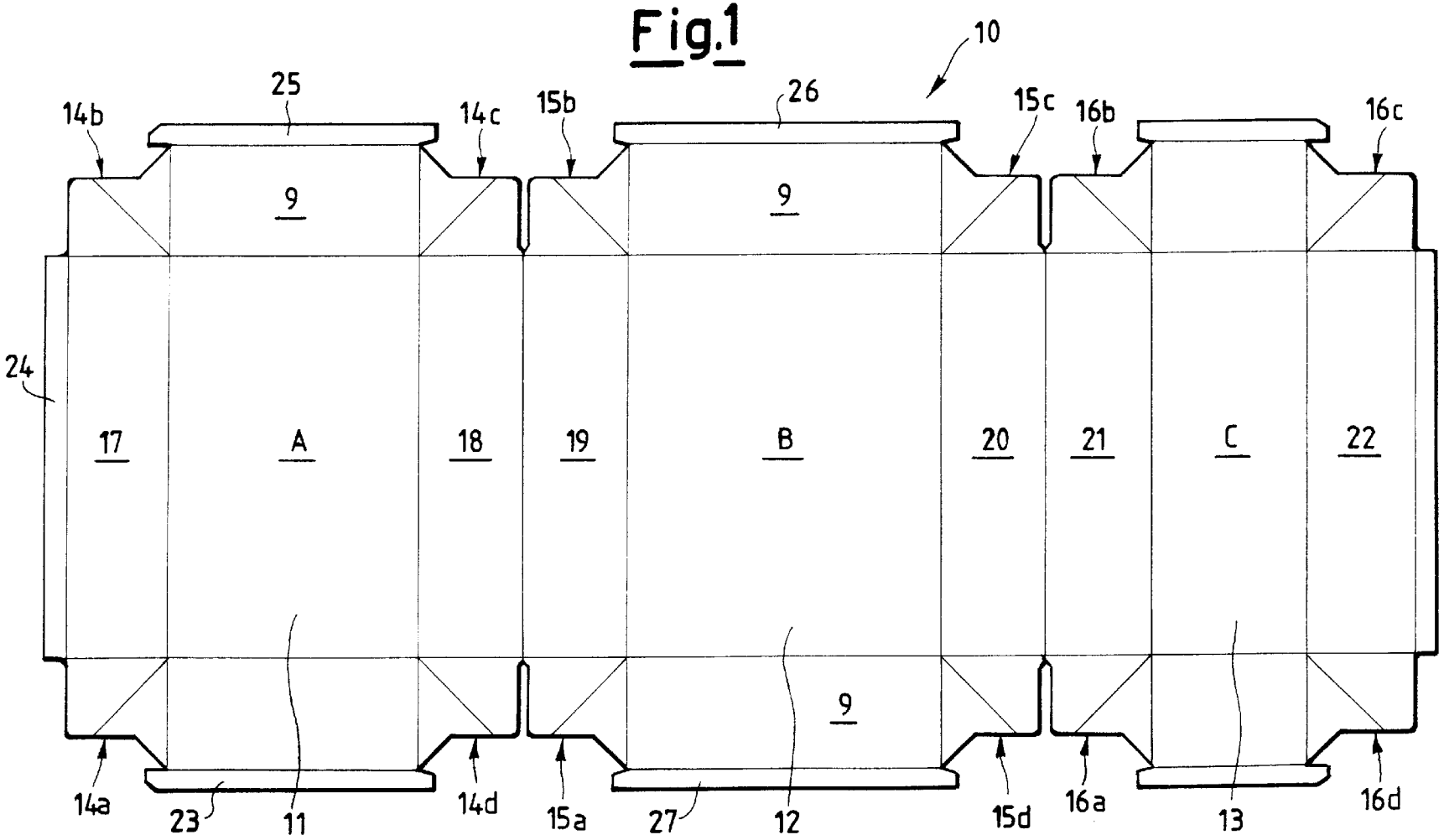
FIG. 1 is a plan view of a punched cardboard blank for manufacturing a container according to the present invention.

In FIG. 1, the reference numeral 10 indicates overall a cardboard blank shaped by punching, from which a three-compartment container will be made. The thin lines represent creasing or weakening lines about which the cardboard blank must be folded in the shaping stations of the manufacturing plant.

The reference numerals 11, 12 and 13 indicate the three base surfaces of the three compartments A, B and C into which the container will be divided. The reference numerals 14*a*, 14*b*, 14*c* and 14*d* indicate respectively the corner zones which when folded form the four corner sutures of the first compartment A.

Correspondingly, the numerals 15*a*, 15*b*, 15*c*, 15*d*, 16*a*, 16*b*, 16*c* and 16*d* indicate respectively the corner zones of the other two compartments B and C.

The reference numerals 17 and 22 indicate the transverse vertical end surfaces of the entire three-compartment container. The surfaces indicates by the reference numerals 18, 19, 20 and 21 are those surfaces which will be positioned vertically in pairs to separate the compartments A, B and C from that adjacent to it. The surfaces which when positioned vertically bound the compartments A, B and C laterally lie adjacent to the base surfaces 11, 12 and 13 on both sides.

Figure 2:
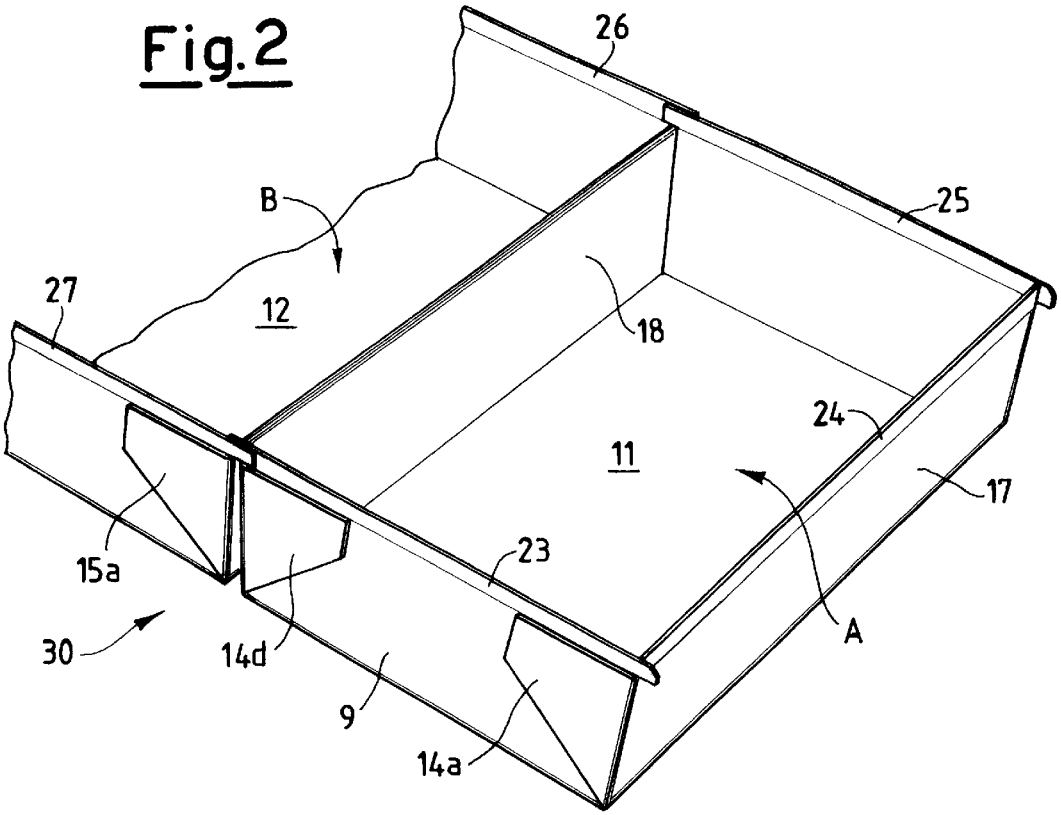
FIG. 2 is a cut-away view of the container blank shown in FIG. 1, shaped into its final form.

On leaving the initial shaping station and, if provided, the thermowelding station, the shaped blank 10 (in FIGS. 2 and 3 the shaped container is indicated by the reference numeral 30) has the appearance shown in FIG. 2. The corner zones 14*a*, 14*d* and 15*a* are folded back and secured (bonded) to the container walls in such a manner as to form corner sutures which firstly prevent the container 30 from undergoing deformation and secondly prevent its contents from escaping. The vertical walls of the compartment have their upper edges 23, 24, 25, 26 and 27 parallel to the rest of the edge.

Figure 3:
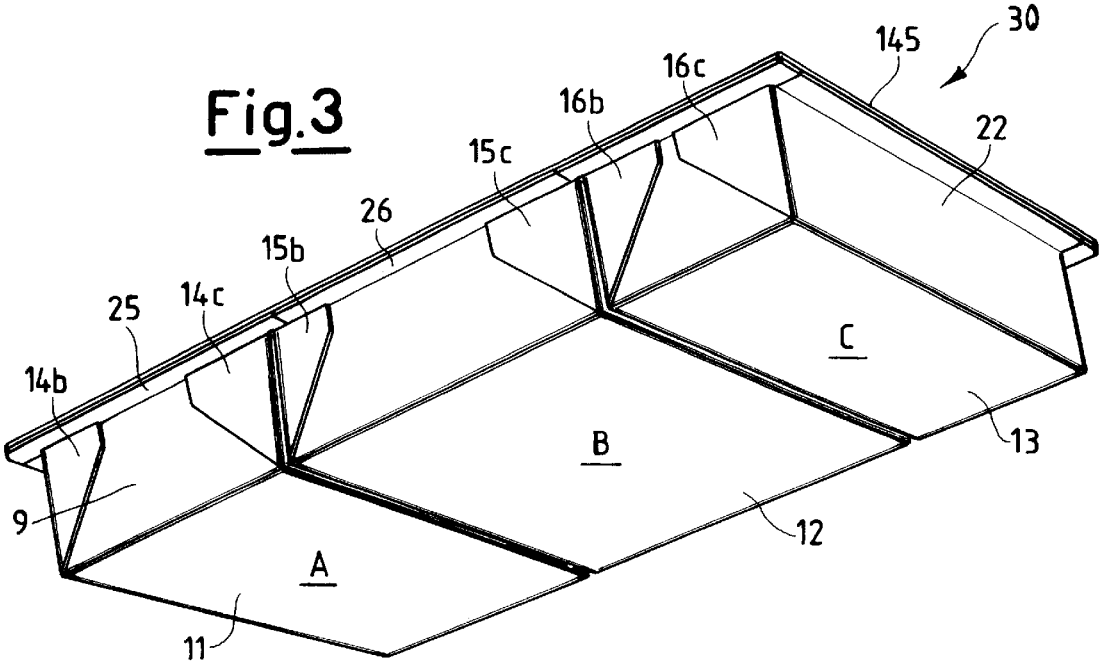
FIG. 3 is a perspective view of the formed container shown in FIG. 2 closed by a suitable lid.

FIG. 3 shows the container 30 to which the lid 145 has also been applied, by being bonded (in the manner described hereinafter) onto said edges 23, 24, 25, etc. after they have been folded horizontally outwards.

Figure 4:
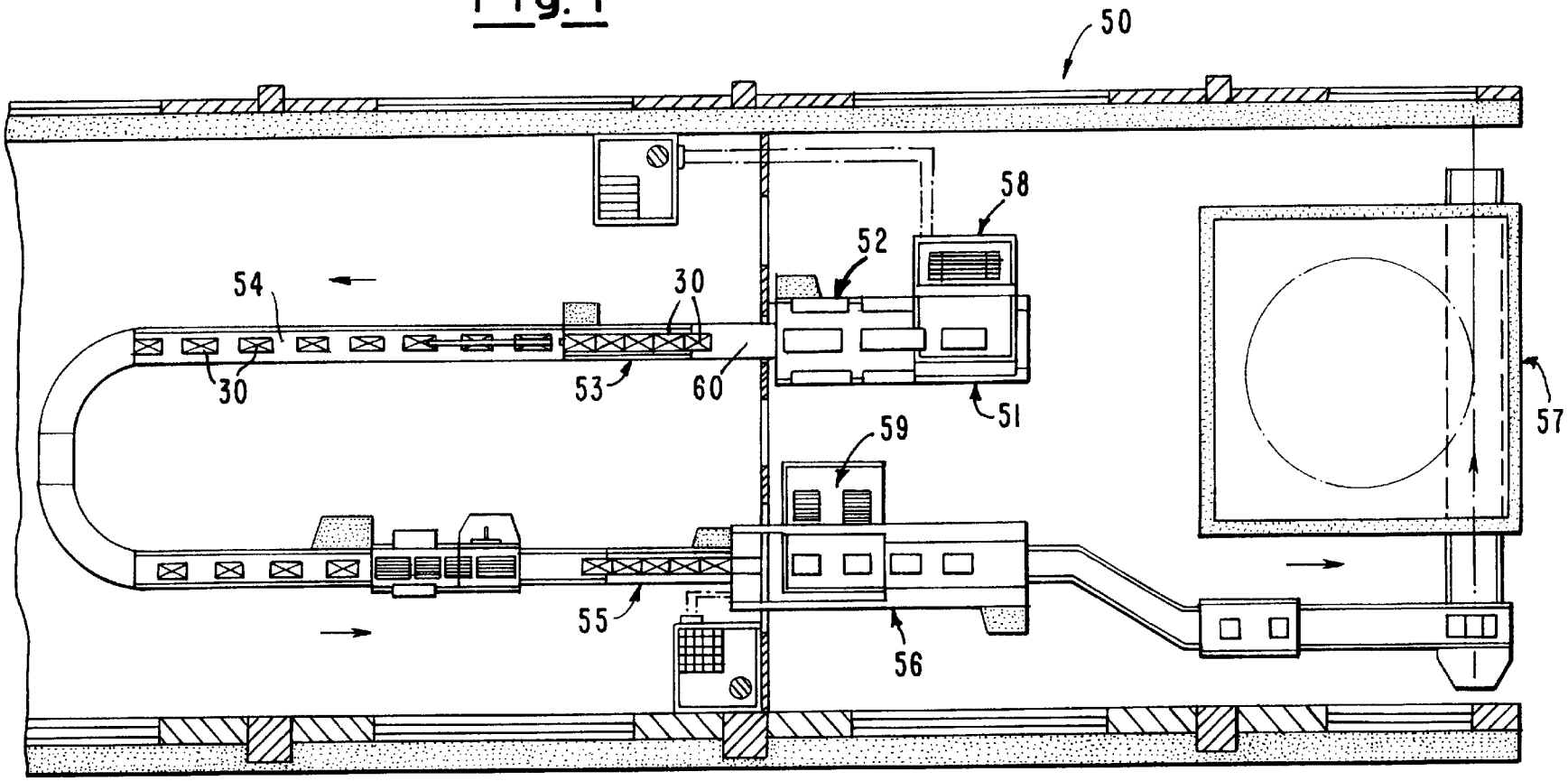
FIG. 4 is a schematic overall view of a plant for packaging food products in which a container manufacturing plant of the present invention is inserted.

In FIG. 4, the reference numeral 50 indicates overall a packaging plant for food products, in which a significant part of the plant comprises the arrangement of the present invention. Said plant is shown schematically, and is intended to be more symbolic than descriptive.

Punched cardboard blanks, contained in a feeder 58, are fed in succession at regular intervals to the initial shaping station 51, in which they receive an initial shaping and in which the corner sutures are welded. Conveyed by an intermittently moving conveyor belt 60 provided with suitable retainers, said cardboard blanks then undergo welding of their adjacent side walls between one compartment and the next in a thermowelding station 52.

On leaving said station 52, the shaped containers 30 are collected in a buffer store 53 from which they are transferred to a continuously moving conveyor belt 54. The devices for filling the containers are located along said conveyor belt 54. These filling devices, of any conventional or non-conventional type, load the appropriate foods into one or more compartments A, B and C of the container 30.

When the containers have been filled, they are collected in the final shaping station 55, from which they are transferred to a station 56 for closing the containers with a lid. The lids are taken from a relative feeder 59.

On leaving the lid closure station 56, the containers are conveyed to a store 57, which can be for example a freezer or deep-freezer.

Figure 5:
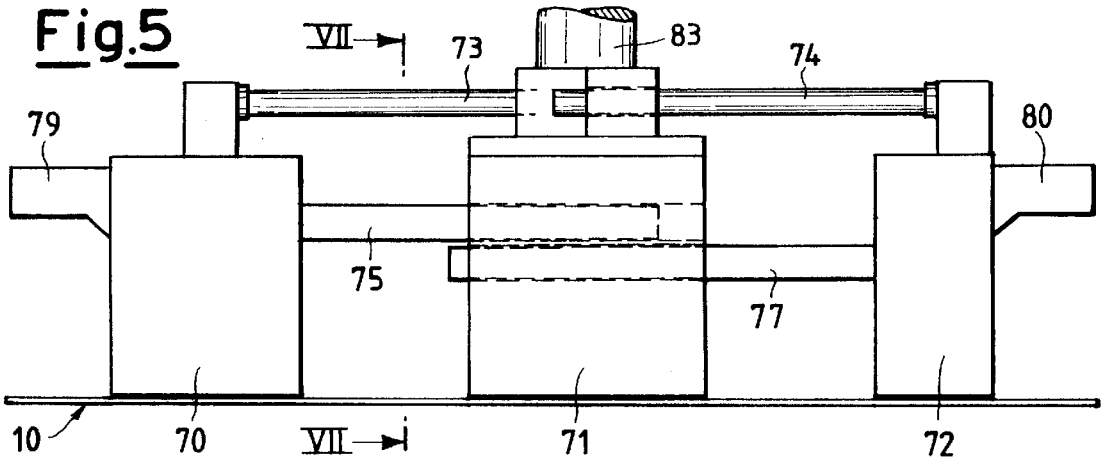
FIG. 5 is a side view of the assembly of forming heads provided in an initial shaping station of a container manufacturing plant of the present invention.
Figure 6:
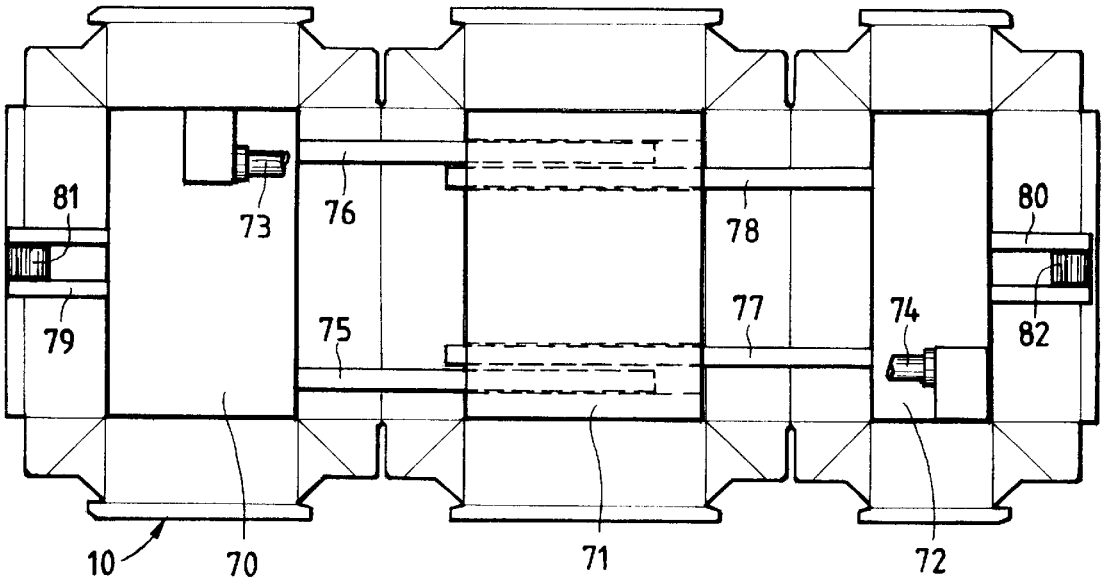
FIG. 6 is a view from above of the forming heads of FIG. 5, just about to act on the blank of FIG. 1.
Figure 7:
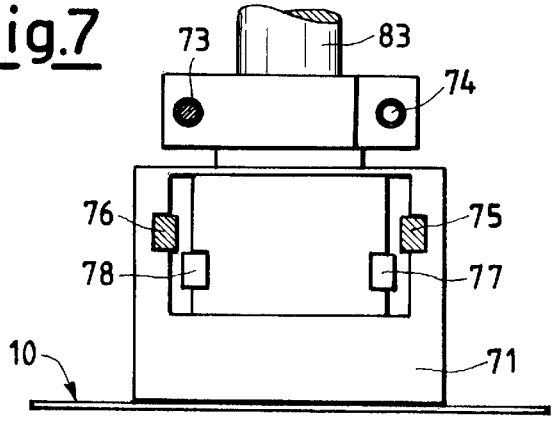
FIG. 7 is a section on the line VII—VII through the assembly of forming heads shown in FIG. 5.

FIGS. 5 to 7 show in detail the assembly of forming heads only with which the initial shaping station 51 of the plant of the present invention is provided.

The illustrated arrangement is for manufacturing a three-compartment container, such as that shown in FIG. 3.

The assembly is formed from three heads 70, 71 and 72, each of which interacts with one of the base surfaces A, B and C of the container 30. The three heads 70, 71 and 72 are secured to each other by two circular centering bars 73 and 74 and by two pairs of slide bars 75, 76 and 77, 78 of quadrangular cross-section.

The two outer heads 70 and 72 are provided with respective lateral projections 79 and 80 consisting of two spaced-apart flanges between which a roller 81 and 82 is inserted.

The entire forming head assembly is moved (in the vertical direction) by a shank 83 driven by a mechanism, not shown.

In FIGS. 5 to 7 the forming head assembly is shown resting on the cardboard blank 10 from which the container 30 is to be obtained.

Figure 8:
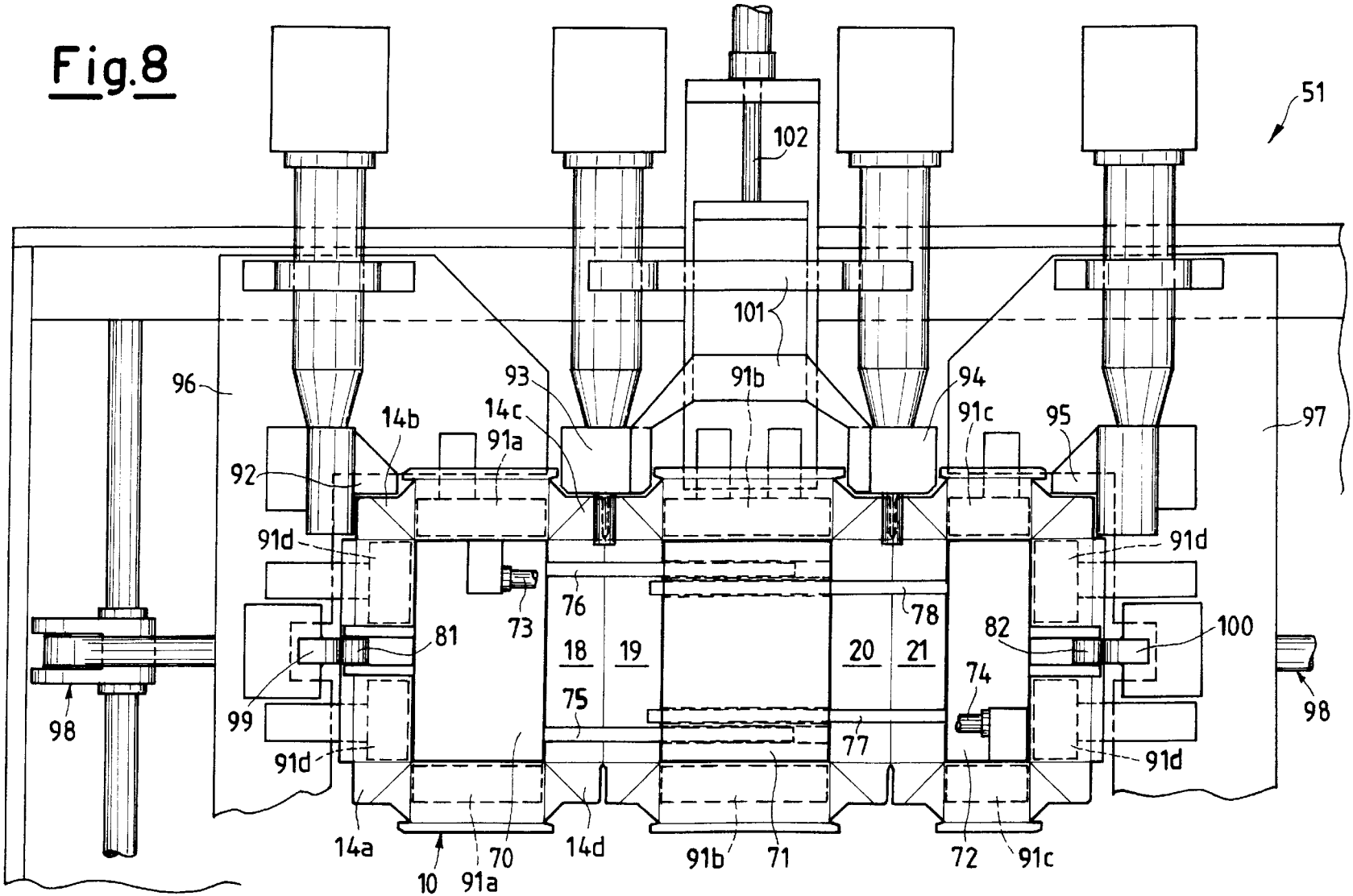
FIG. 8 is a view from above of part of a preferred embodiment of the initial shaping station of the plant of the present invention.

FIG. 8 shows part of the initial shaping station 51. As this station is virtually symmetrical about a longitudinal axis (the axis parallel to the long side of the container), this representation is sufficient to show the entire structure of the station 51.

The cardboard blank 10, when transferred to the station 51 by a sucker system (not shown) which withdraws it from a pile of blanks contained in a feeder 58, rests on sectors, such as support bases which provide counteracting and creasing means, (shown in FIG. 8 by dashed lines) indicated by the reference numerals 91*a*, 91*b*, 91*c*, 91*d* and so on. These sectors have a surface rounded about a horizontal axis, 91*a'*, 91*b'*, 91*c'*, 91*d'* and facilitate the folding of the blank about its creasing lines. The folding action is provided by the forming heads 70, 71 and 72, which cooperate with these sectors. The head assembly moves vertically downwards (FIG.9*a*),causing the blank to become inserted in the perimetral groove 104 by said sectors. Their rounded lead-in shape makes the progressive folding of the blank more simple, smooth and progressive. In practice a gap equal to approximately the thickness of the the blank remains between the forming heads and the vertical walls of the sectors. This movement results both in the formation of the lateral walls of the container (including those separating one compartment from the next as it will be seen hereinafter) and the folding and turning of the corner zones 14*a*, 14*b*, 14*c*, 14*d* , etc. to form triangular lugs.

In correspondence with said corner zones, the initial shaping station 51 is provided with nozzles 92, 93, 94 and 95 from which hot air at a temperature between, for example, 60° C. and 550° C. emerges, the air originating from a suitable conventional hot air distribution system. Correspondingly, on that side of the station 51 not shown, there are provided a further four nozzles positioned in an entirely similar manner.

The lateral nozzles 92 and 95 are rigid with relative plates 96 and 97 subjected to reciprocating lateral movement by the toggle mechanism indicated by the reference numeral 98. The plates 96 and 97 carry vertical rods 99 and 100, which interact with the rollers 81 and 82 when the forming head assembly 70, 71 and 72 is lowered. As the plates 96 and 97, and with them the rods 99 and 100, move in the lateral direction towards the centre of the blank, their movement is accompanied by a similar movement of the heads 70 and 72. These latter simultaneously continue their downward movement to form the container 30.

Figure 9:
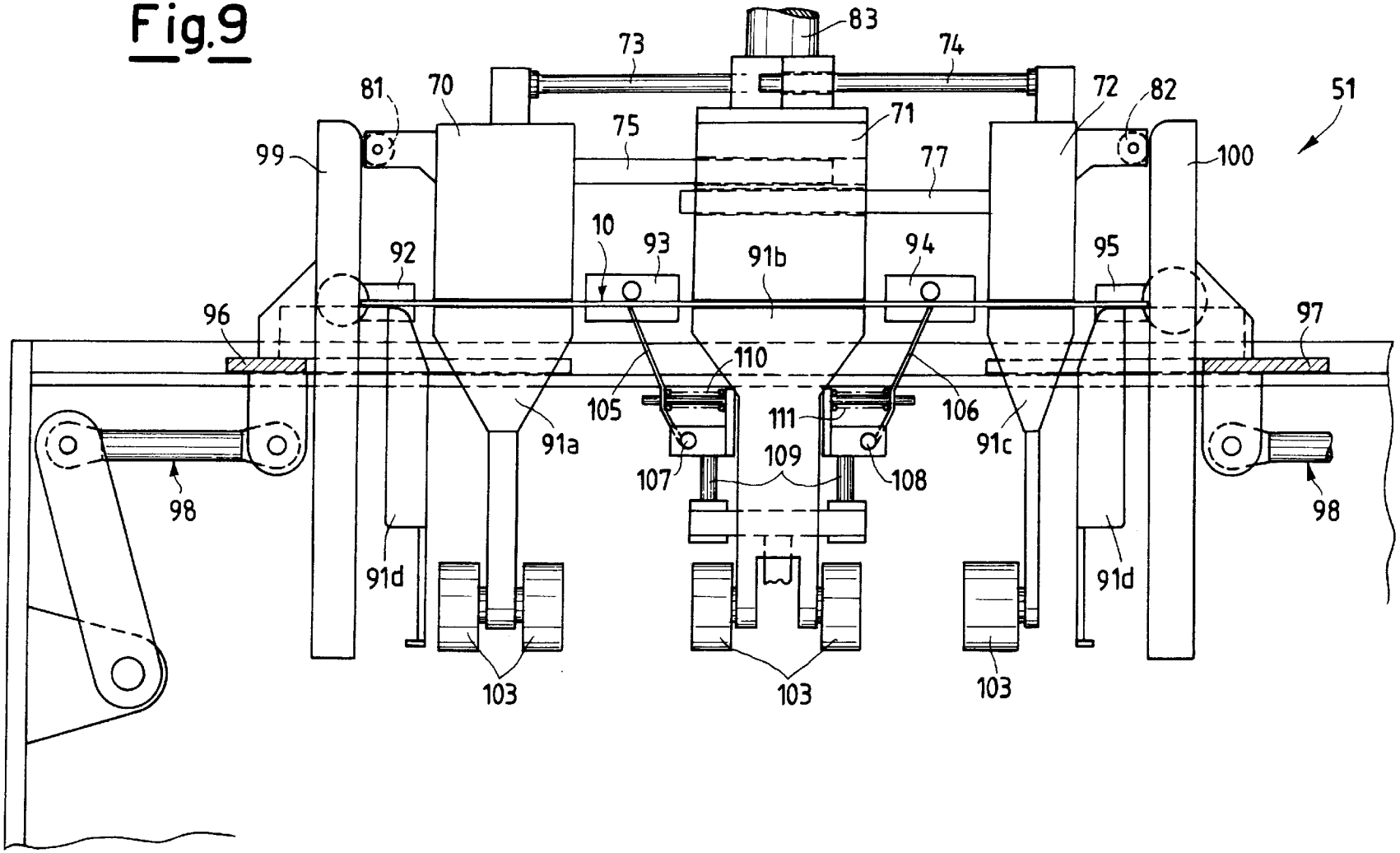
FIG. 9 is a side view of the initial shaping station of the present invention shown in FIG. 8
Figure 9A:
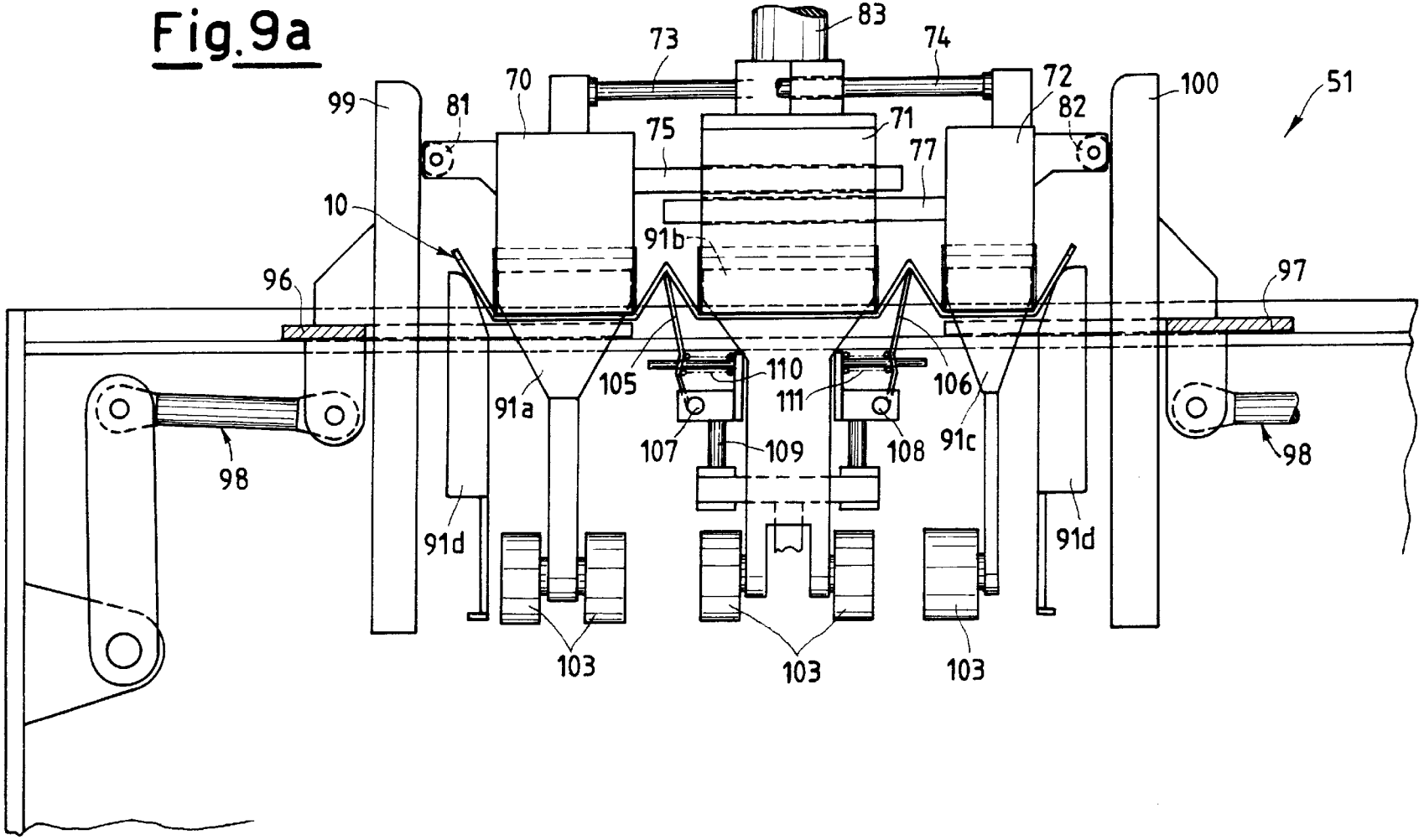
FIG. 9*a* is a similar view in a different operative position.

As can be seen from FIG. 9, the sectors 91*a*, 91*b*, 91*c* etc. are provided with a respective downward extension, on which rollers 103 are provided. The rollers 103 are preferably constructed of hard rubber or wear and heat resistant material, and are free to rotate.

The two central nozzles 93 and 94 are rigidly joined together by the joining elements 101. Said joining elements 101 are fixed to a shaft 102 which is made to move parallel to itself by a conventional drive system, not shown.

When the cardboard blank is rested on the sectors 91*a*, 91*b* etc., the forming head assembly 70, 71, 72 is raised. The two nozzles 93 and 94 which, in order not to interfere with the space within which said blank 10 is moved, are in a withdrawn position are now thrust by the shaft 102 to assume the position shown in FIG. 8. At this point, while the forming head assembly begins to descend towards the blank, hot air is blown by all the nozzles to heat the cardboard blank and cause the thin polymer layer, for example polyethylene, polyester etc. with which the cardboard is coated, to melt in the corner zones. The reaction of the rollers 103 against the blank, this reaction occurring precisely in correspondence with said corner zones, secures these zones to the underlying cardboard to form the sutures which prevent the container 30 from opening and its contents from escaping.

The initial shaping station 51 is completed by further counteracting means comprises two strips 105 and 106 pivoted at respective points 107 and 108 of a carriage 109. The strips are further engaged by two springs 110 and 111 which cause them to diverge (see the position in FIG. 9).The carriage 109 is movable vertically and horizontally.

The explicit function of the two strips 105 and 106 is as follows. While the blank 10 is moved downwards by the movement of the forming head assembly 70, 71 and 72, the strips 105 and 106 engage the blank 10 along the lines which separate two adjacent compartments (in the case of the blank 10, the lines which bound the zones 18 and 19 between the compartment A and the compartment B, and the zones 20 and 21 between the compartment B and the compartment C). As the carriage 109 on which said strips 105 and 106 are mounted is maintained at rest, the engagement between the strips and the blank maintains the thus engaged cardboard flap raised. Simultaneously, the movement of the lateral forming heads 70 and 72 towards the central head 71 reduces the distance between the compartments A,B and B,C, so as to cause the two strips to approach each other. This movement is free, even though partially opposed by the springs 110 and 111. With the movement completed, ie when the forming heads 70 and 72 are virtually adjacent to the central head 71, the strips are in a vertical position. At this point they are lowered (by lowering the carriage 109) and removed from the overall boundary limits of the container 30 (ie they are moved towards the outside of the initial shaping station 51).

At this point the container 30 has been suitably formed and shaped, and is discharged onto the underlying retainer-type conveyor belt (not shown). In preferred embodiments of the present invention, the discharge of the shaped container 30 may be aided by a system comprising suckers or a similar type of suction system, such that the container does not follow the upward movement of the forming heads, but is correctly deposited between two successive retainers on said conveyor belt.

Figure 10:
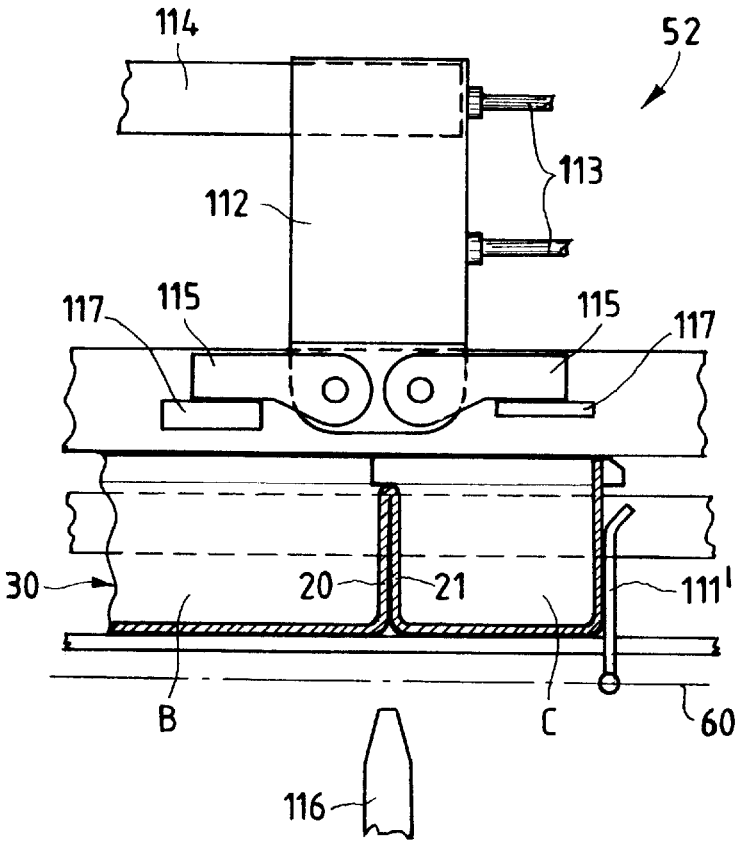
FIG. 10 is a side view, in its open position, of a thermowelding element pertaining to the thermowelding station of the present invention.
Figure 11:
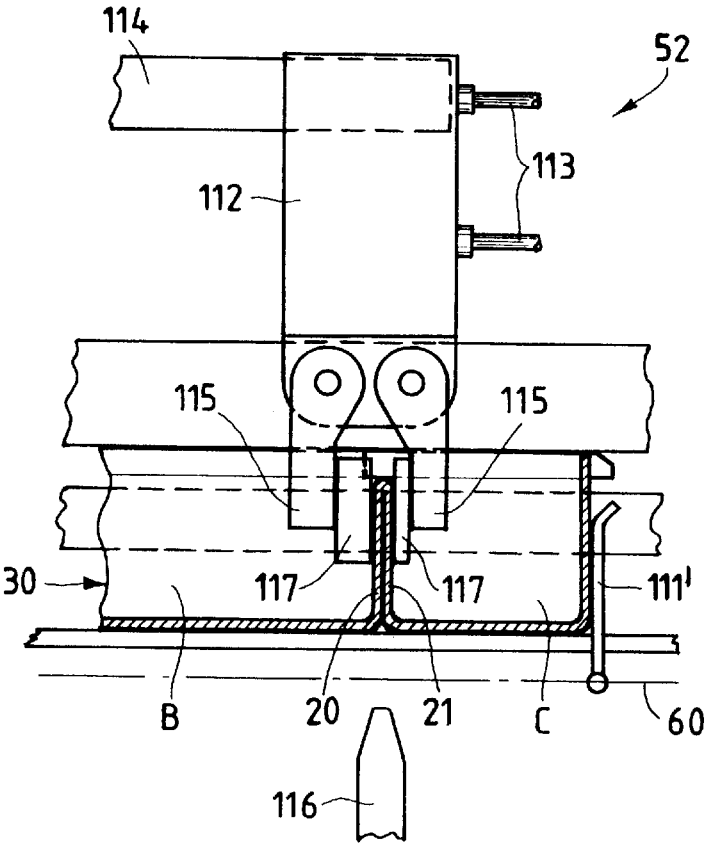
FIG. 11 is a side view, in its closed position, of the thermowelding element shown in FIG. 10.

After this, and only if the container 30 has more than one compartment, the container is transferred by the same conveyor belt 60 to a thermowelding station 52, in which the vertical walls bounding each adjacent compartment are welded together. (FIGS. 10 and 11). The outer vertical walls of the container, ie those which bound it laterally, are not subjected to this welding action.

The thermowelding station comprises a plurality of welding elements consisting of an arm 112 supported by a bar 114 and movable into and out of the boundary limits of the conveyor belt 60, and carrying two grippers 115 pivoted to it. Said grippers 115 are provided with a terminal pad 117 of hard rubber or plastic material which is pressed against the vertical walls of the container 30.

Electrical connections 113 emerge from said arm 112 for powering a system of electromagnets which open and close the two grippers 115. The two situations (grippers open and grippers closed) are effectively shown in FIG. 10 and FIG. 11.

Below the conveyor belt 60 there is provided, for each welding element, one or more apertures or nozzles 116 for blowing hot air originating from a suitable conventional hot air distribution system.

The operation of the thermowelding station or rather of each welding element is as follows: by means of the retainers 111' with which it is provided, the conveyor belt 60 causes the containers 30 to advance one by one. The movement of the conveyor belt 60 is intermittent, so that the belt 60 and hence the container 30 are at rest at the moment in which the respective welding element starts to operate. When a container 30 is below the welding element, with the lateral walls 20 and 21 on the center line through the two grippers 115, hot air is blown from below through the nozzle or nozzles 116, in correspondence with the bellows created by the two lateral walls 20 and 21 bounding the two compartments B and C. The hot air softens the layer of food-quality thermoweldable polyethylene or varnish with which the blank is coated. Immediately afterwards, the two grippers 115, driven by the electromagnet operated via the electrical connections 113, move into the closed position shown in FIG. 11. The two pads 117 forcibly clamp the container walls 20 and 21 together, said two walls becoming bonded together when the previously softened food-quality thermoweldable polyethylene or varnish cools.

At this point the two grippers 115 reopen and the conveyor belt 60 recontinues its movement.

At least one welding element for each vertical partitioning wall of the container compartments is provided. In preferred embodiments, more than one welding element per wall can be provided, to improve the bonding of the two walls for subsequent stages.

On leaving the thermowelding station 52 the container 30, without its lid, is ready for filling with the required contents, for example food. The container 30 is firstly transferred to a buffer 53, from which it is transferred to a continuously moving conveyor belt 54.

The container is filled by machines of conventional type lying outside the scope of the present invention, which are located along the belt 54. Filling can take place compartment by compartment, or simultaneously for more than one compartment, or food product by food product, in the most free and advantageous form possible.

The equipment positioned along said conveyor belt 54 can also comprise weighing, cooling or heating elements, elements for mixing the various food components, and so on according to requirements.

When filling and any additional processing is complete, the containers 30 are transferred to a final shaping station 55, from which a belt 120 transfers them to a station 56 for closing the container lids.

Figure 12:
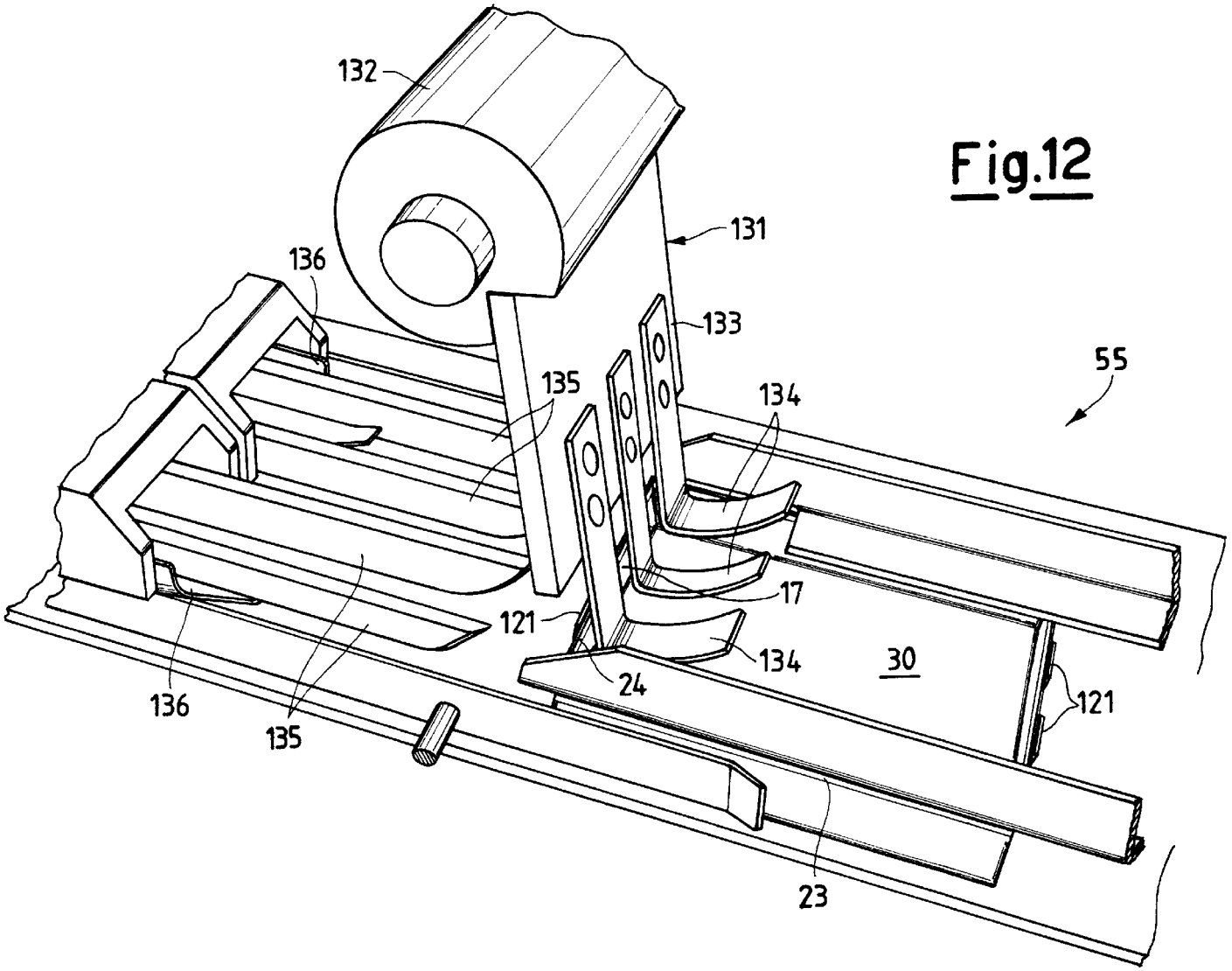
FIG. 12 is a perspective view of a first detail of the final shaping station for the container according to the present invention.
Figure 13:
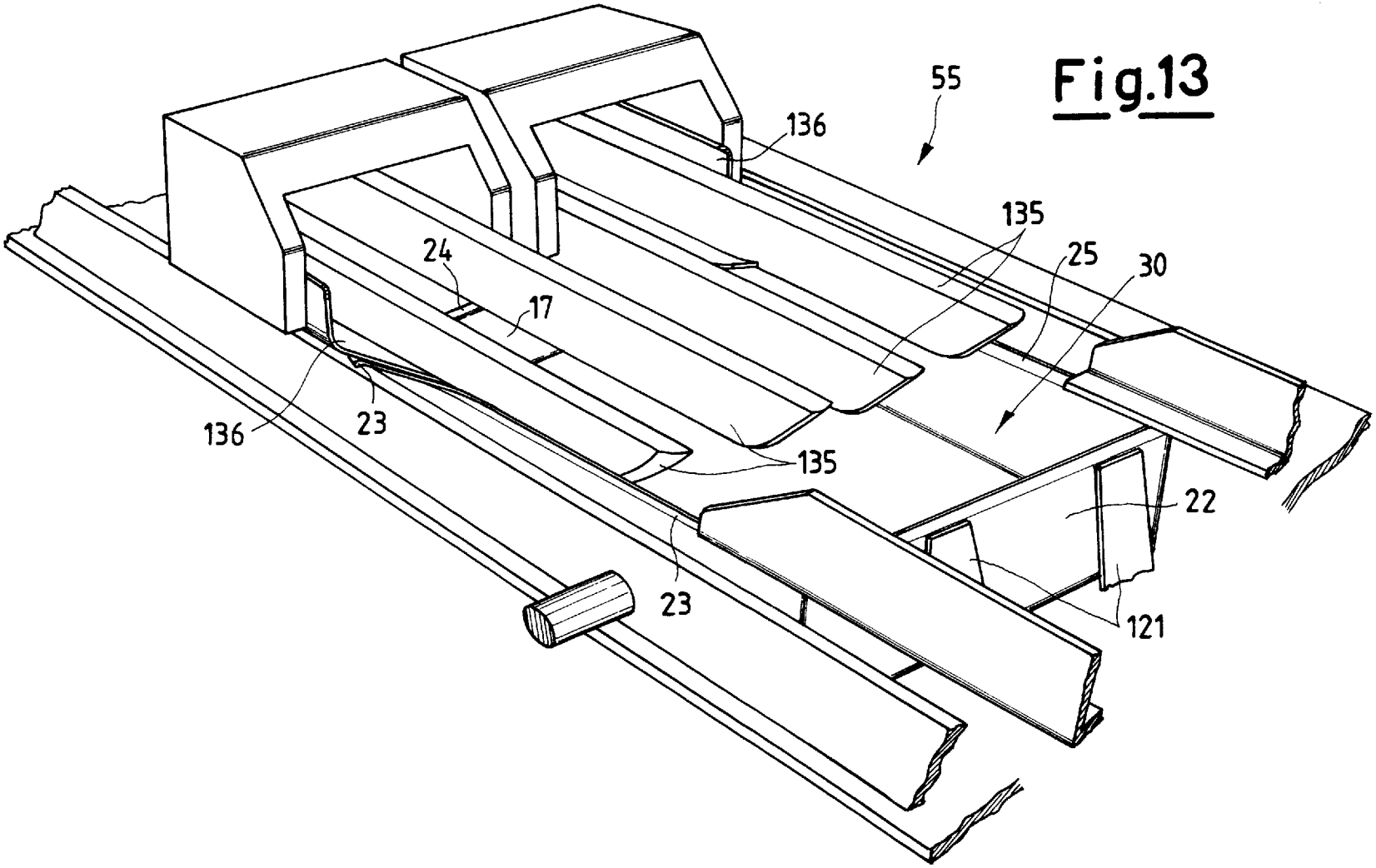
FIG. 13 is a perspective view of a second detail of the final shaping station for the container according to the present invention.
Figure 14:
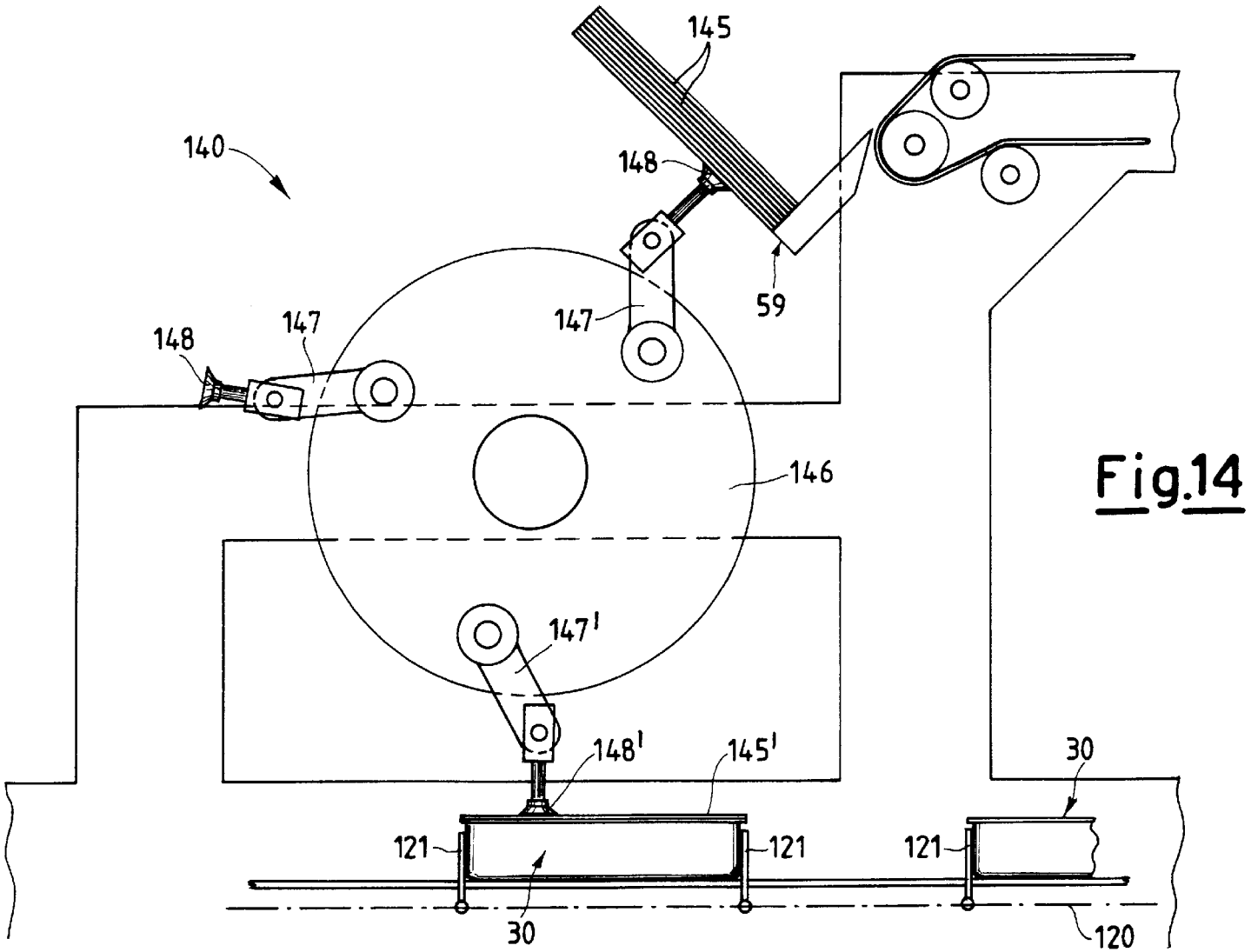
FIG. 14 is a side elevation of a detail of the container closure station according to the present invention.
Figure 16:
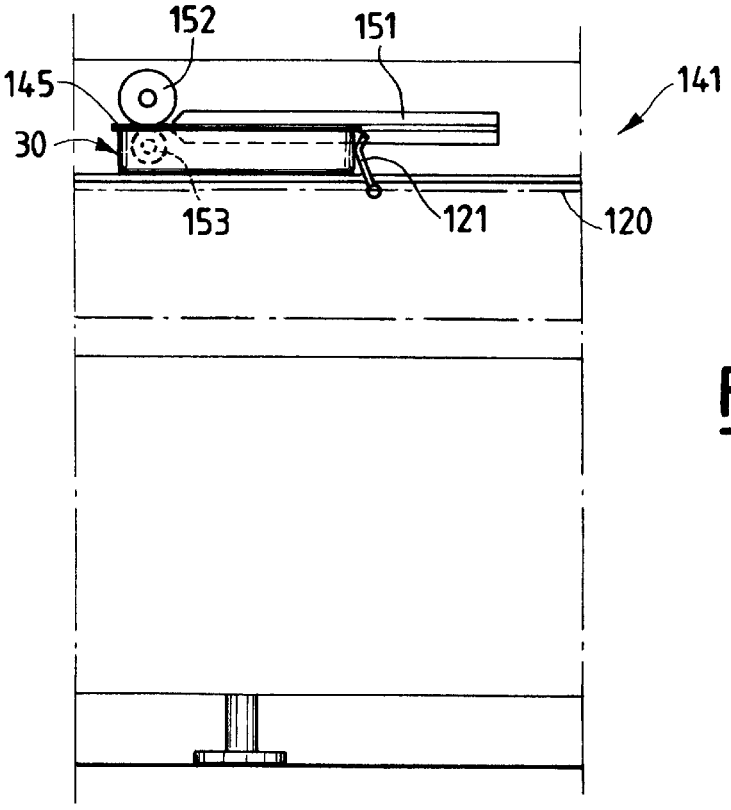
FIG. 16 is a side view of the detail shown in FIG. 15.

FIGS. 12 and 13 show by way of example the structure of the final shaping station 55. In the station 55 the edges of the container 30, made vertical by the initial shaping station 51, are folded horizontally.

The station 55 is suitable for horizontally folding the vertical edges of a cardboard blank shaped by the method used in the initial shaping station 51 or one similar thereto. Folding is effected continuously, in contrast to conventional machines. The station 55 has two separate sections, in the first of which the front edge (with respect to the direction of advancement of the container 30) is folded horizontally and in the second of which the other three edges are folded horizontally.

The final shaping station 55 consists of a conveyor belt 120 provided with retainers 121 which continuously convey the containers the edges of which are to be folded over.

At a suitable distance above said belt 120 there is provided a folder element 131 rotating about a pin 132. The rotating folder element is used to fold horizontally the front edge of the container 30. The rotation is achieved by a suitable drive system, not shown, which causes rotational movement at a fairly high speed in the same direction (when at the point of proximity) as the advancement of the conveyor belt. Opportunely, defining $V_t$ as the tangential velocity of the folder element 131 (equal to the product of the rotational velocity of the pin 132 and the distance of the end of the folder element 131 from the pin 132), and defining $V_n$ as the velocity of horizontal advancement of the conveyor belt, $V_t$ should be greater than $V_n$. Advantageously $V_t$ is a multiple of $V_n$, for example $V_t \geqq V_n$.

The folder element 131 consists of a plate 133 to which are fixed a plurality of rakes 134, which in the illustrated embodiment have a curved end to prevent tearing of any parts of the cardboard which may remain trapped (for example where right or acute angles are present).

During its rotary movement, the folder element 131 strikes against the front edge 24 of the container 30 by means of the rakes 134.

The container is retained by the retainers 121 so that it does not shift forward as a result of the blow applied to it by the folder element 131, whereas because of the combined action of the folder element 131 and the reaction of the retainers 121, and because of the yieldability of the preferential creasing line which separates it from the vertical wall 17 of the container, the edge 24 undergoes forward folding along this line.

Then, because the tangential velocity $V_t$ of the folder element is greater than the advancement velocity $V_n$ of the container, the end of the folder element 131 rapidly withdraws from the edge 24 of the container 30.

The container 30 is then made to pass below a series of prongs 135, the height of which from the conveyor belt 120 is such that they are exactly in line with the already folded front edge 24.

The action of the prongs 135 is as follows (with reference to FIG. 13): the central prongs 135 oblige the rear edge (parallel to the front edge 24) of the container to fold rearwards. Simultaneously, the lateral prongs 135 gradually force the lateral edges 23, 25, 26 and 27 to pass below a respective longitudinal lateral guide 136, which maintains them pressed in a horizontal position. Again in this case the edges 23, 25, 26 and 27 fold about a preferential creasing line which joins them to the rest of the container.

On leaving the final shaping station 55 all the edges of the container 30 have been folded horizontally. At this point it is ready to be closed with its lid. This is achieved by the subsequent closure station 56.

The station 56 for closing the containers 30 with a lid consists substantially of four sections. In a first section 140, a lid 145 withdrawn from a feeder 59 is positioned on the container. In a second section 141 those edges positioned on two opposing sides of the container 30 are bonded to the lid 145. In a third section 142 the container is rotated through 90° and in a fourth section 143 the edges on the other two opposing sides of the container 30 are bonded.

The conveyor belt 120 on which the containers 30 leaving the final shaping station 55 are positioned, retained by the retainers 121, passes through the lower part of the first section 140, which is used only to position the lid 145 on the container 30. Above the conveyor belt 120 there is a wheel 146, driven continuously (with regular steps) by a drive not shown, and carrying a plurality of arms 147 each provided with a respective sucker system 148. In the illustrated embodiment, three said arms are provided.

The lids 145 are stacked in a feeder 59, from which they are withdrawn one at a time by a respective sucker system 148. At the same time another sucker system 148' lies on the vertical axis through the container 30, retaining a relative lid 145'. At this point suction is removed from the sucker system 148', with the result that the lid 145' falls onto the container 30.

Perfect coincidence between the edges of the lid 145' and the edges of the container 30, to which they will subsequently be bonded, is ensured by the presence of the retainers 121 and two lateral guides (not shown herein) which laterally confine each container 30.

Figure 15:
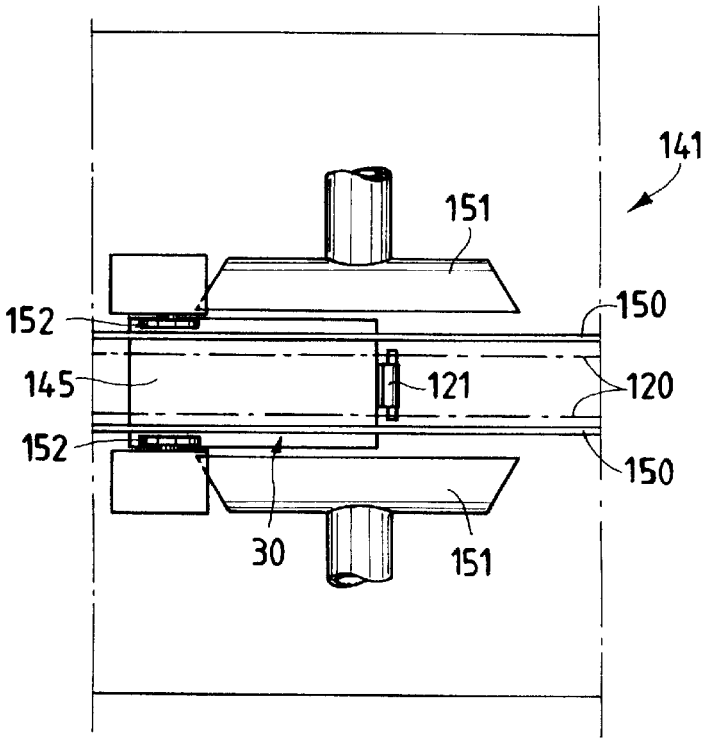
FIG. 15 is a view from above of a detail of the container closure station of the present invention.
Figure 17:
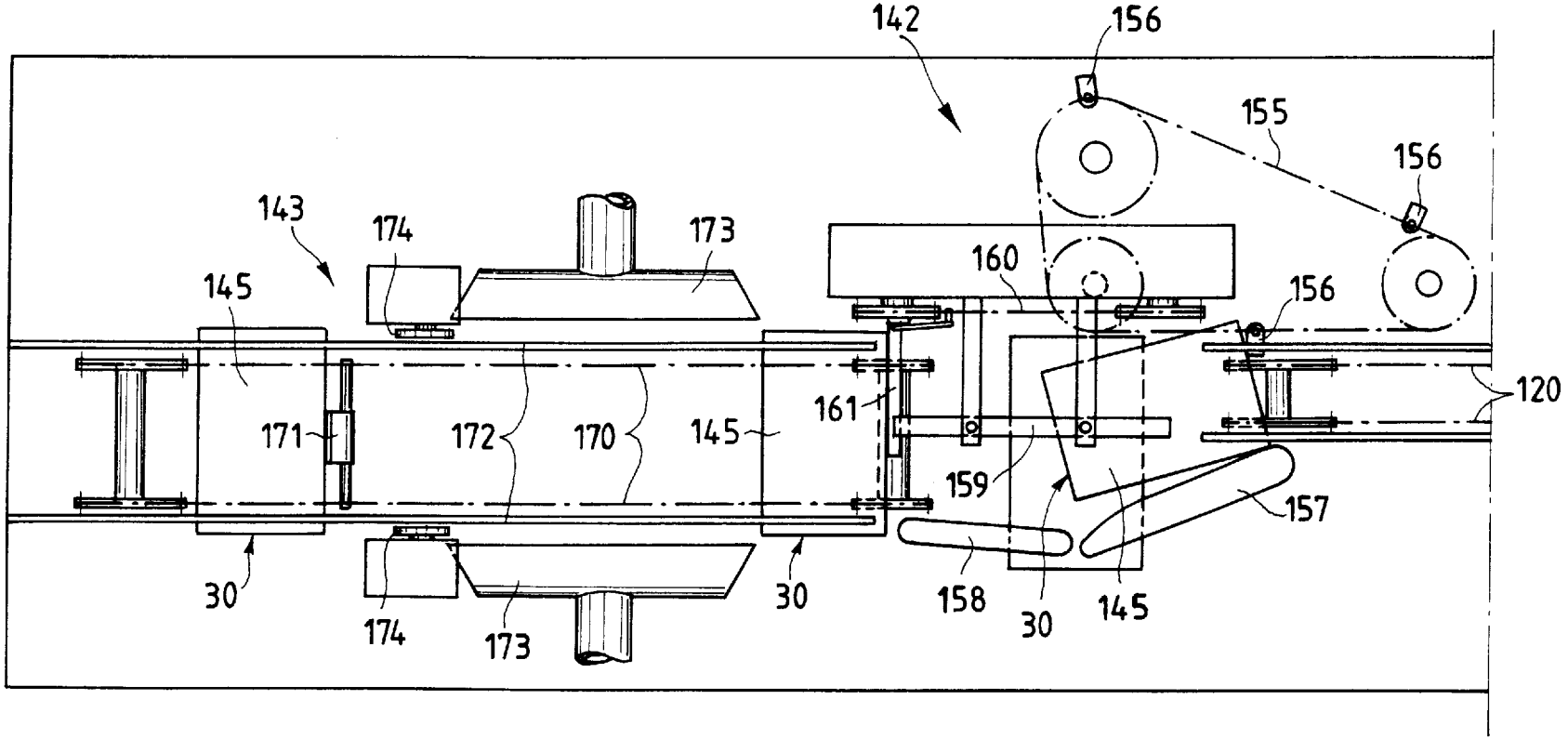
FIG. 17 is a view from above of a further detail of the container closure station of the present invention.
Figure 18:
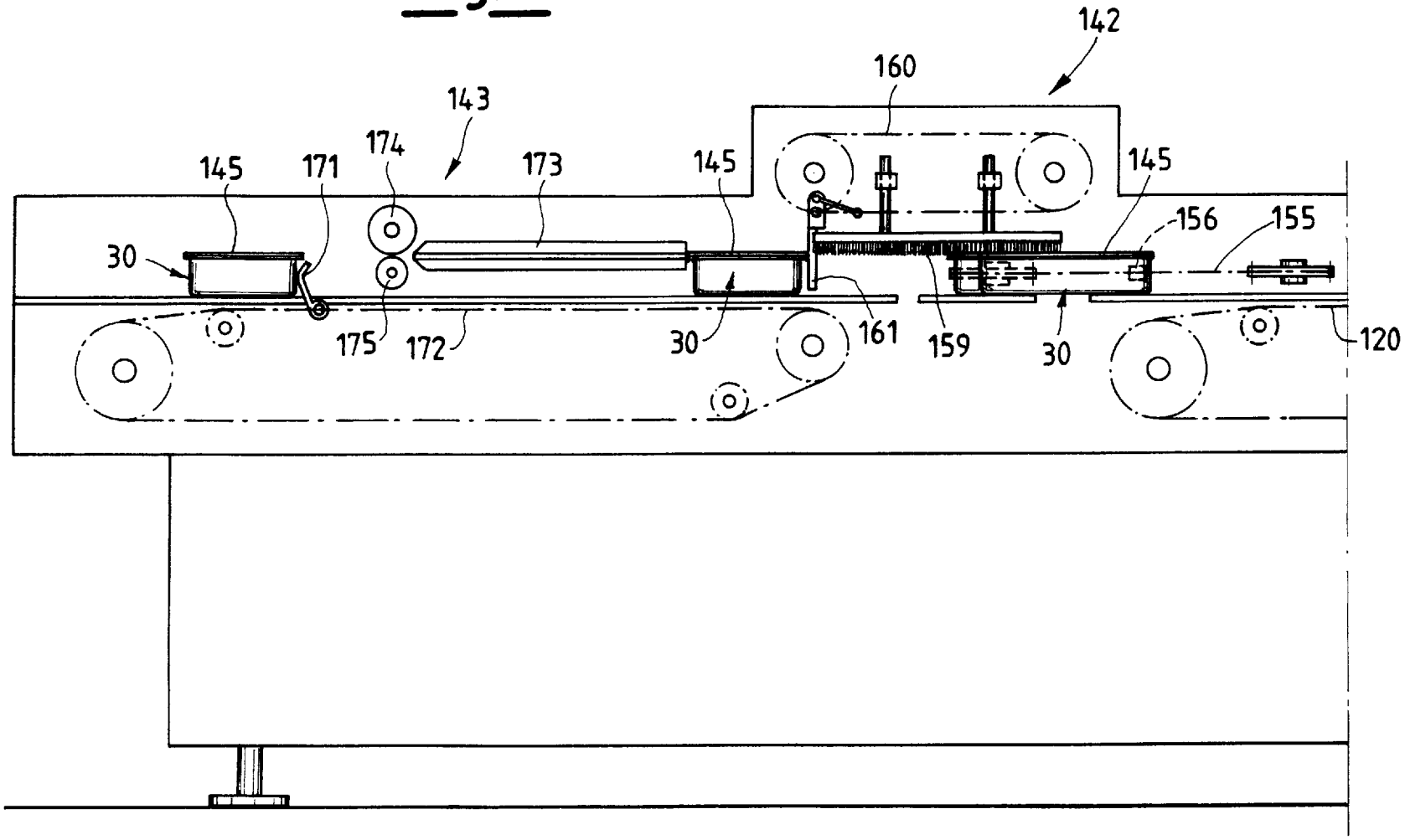
FIG. 18 is a side view of the detail shown in FIG. 17.

These guides are however shown in FIG. 15, which represents a view from above of the section 141 in which the lateral edges of the container 30 are bonded to the lid 145. The conveyor belt 120, laterally bounded by two lateral guides 150, passes through this section conveying the container 30 by means of retainers 121. On each side of the belt 120 there are provided two very elongate nozzles 151 from which there blows hot air, for example between 50° C. and 650° C., originating from a suitable conventional hot air distribution system. The two nozzles 151 form an actual respective slot into which the ends of the lateral edges of the lid 145 and container 30 are inserted.

The hot air emitted by the nozzles 151 heats the cardboard and dissolves or at least softens the polyethylene layer on it.

On leaving said nozzles 151 the container 30 encounters two pairs of rollers 152 and 153, the position of which is such as to interact lowerly with the lateral edges of the container 30 and upperly with the lateral edges of the lid 145. These rollers hence act to clamp the two edges together, bonding being effected as the two facing layers of polyethylene cool.

On leaving the section 141 the container is received by the section 142, which rotates it through 90° about a vertical axis. The container 30, still urged by the retainers 121 on the belt 120, is laterally struck at the end of this belt by one of a series of feet 156 fixed to a belt 155 rotating in a horizontal plane and positioned laterally to the belt 120. The belt 155 moves at a greater velocity than the belt 120 and hence than the advancement velocity of the container 30.

The thrust of the foot 156 on the side of the container 30 (in this respect the foot 156 moves more rapidly than the container 30) is such that the container is urged outwards towards the opposite side to the belt 155. On this side it rests on two lead-in elements 157 and 158, mutually arranged to form a V, which guide its rotation about a vertical axis. At the same time a part of it continues to be entrained by the belt 120.

The rotation is completed by the action of blades 161 mounted on a belt 160 which rotates in a vertical plane on the same side of the container as the belt 155. Each blade 161 makes contact with the side of the container 30 which during its advancement by the belt 120 was parallel to the direction of advancement. That surface of the blades 161 which rests against said side of the container 30 is perpendicular to the plane of rotation of the belt 160. The action of each respective blade 161 completes the 90° rotation of the container 30 about a vertical axis.

The containers 30 are prevented from rearing vertically or emerging from their assigned path by a longitudinal brush 159 positioned at suitable height.

On leaving the section 142, the containers have been rotated through 90° and enter the section for bonding those edges not yet bonded, entrained by a further belt 170 provided with retainers 171. The edges concerned in this second bonding are those which at this point are now lateral.

The section 143 is structurally identical to the section 141 with the exception that its width and hence the distance between the two lateral guides is different, depending on the container dimensions.

In the section 143, the conveyor belt 170, laterally bounded by two lateral guides 172, conveys by means of retainers 171 the container 30 on which the lid is as yet bonded only on two sides. On each side of the belt 170 there are provided two very elongate nozzles 173 from which hot air is blown, for example between 50° C. and 650° C. The two nozzles 173 form an actual slot into which the ends of the lateral edges of the lid 145 and container 30 are inserted.

The hot air emitted by the nozzles 173 heats the cardboard and dissolves or at least softens the polyethylene layer on it. On leaving said nozzles 173 the container 30 encounters two pairs of rollers 174 and 175, the position of which is such as to interact lowerly with the lateral edges of the container 30 and upperly with the lateral edges of the lid 145. These rollers hence act to clamp the two edges together, bonding being effected as the two facing layers of polyethylene cool.

At this point, the container 30 has been filled with the foods for which it was intended and has its lid perfectly bonded to it.

On leaving the section 143, the container is discharged, for example to a store, after possible freezing or deep-freezing.

If the container is of the single-compartment type, the plant of the present invention comprises an initial shaping station with only one forming head, which interacts with the single base surface of the container. The preferred number of nozzles is four, one for each of the four corners which are to form the suture elements. It is not necessary to use a carriage with elastically diverging strips, as these are used to aid the correct folding of walls bounding two adjacent compartments of a single container.

The thermowelding station is no longer required, whereas the remainder of the plant is substantially unchanged.

The means for transferring or entraining the containers comprise bands with retainers or conveyor belts or a mixture of the two. In any event the choice of a particular means is not limiting, each arrangement being evaluated in the light of the desired results and constructional and design considerations. The present invention is not based on a particular choice of arrangement of said transfer means.

Modifications can be made to the individual constituent devices of the various aforedescribed embodiments by the expert of the art, according to his experience and requirements, without leaving the scope of the present invention. These modifications can also extend to a different arrangement of the individual devices along the production line, or a different embodiment of the means for transferring the containers from one device to another, or to a different method and organization of the transfer between the entire assembly of devices provided, without these modifications leaving the scope of the present invention.

I claim:

1. A device for manufacturing compartmentally shaped containers, for food use, consisting of a number of compartments equal to or greater than one, which comprises a station (51) for an initial shaping of a container starting from a relative punched cardboard blank (10), a station (55) for a final shaping of edges of the container already shaped by said initial shaping station and a station (56) for closing said container with a lid, in which each blank (10) is fed by feed means (58) to said initial shaping station, means (60, 54) for transferring an initially shaped container being provided between said stations, characterised in that said container (30) has a number of shaped compartments greater than one, said initial shaping station (51) comprising a forming head assembly (70, 71, 72) consisting of a number of forming head elements equal to the number of compartments into which the container is divided, counteracting means having elements **(91*a*, 91*b*, 91*c*, 91*d*, 105, 106)** which cooperate with said forming head elements to deform the blank into a shaped container, and means for discharging said compartmentally shaped container, said forming head elements being movable such that at least one forming head element is movable relative to another forming head element and said elements of said counteracting means also being movable such that at least one said element is movable relative to at least one other said counteracting element.

2. A device as claimed in claim 1, characterised in that said final shaping station consists of a dynamic folding device for horizontally folding a front edge of the container, and static elements for folding a side and rear edges of the container.

3. A device as claimed in claim 2, characterised in that said final shaping station comprises a folder element rotatable about a pin above a container entrainment means which entrain the container in a direction of advancement, said entrainment means being provided with container retention elements, and said folder element rotating in a direction such that at that moment in which it is in proximity to said entrainment means, the direction of its rotation movement is the same as the direction of advancement of said container entrainment means.

4. A device as claimed in claim 3, characterised in that said rotating folder element carries a plurality of rakes at its end.

5. A device as claimed in claim 3, characterised in that said container entrainment means are a conveyor belt with retainers, in which the retainers act as retention elements for the container.

6. A device as claimed in claim 2, characterised in that said static elements consist of a plurality of prongs and two guides lateral to said entrainment means.

7. A device as claimed in claim 1, characterised in that the station for closing said container with a lid comprises a first section in which a lid is positioned on the container, a second section in which two edges of the container are bonded, a third section in which said container is rotated through 90° about a vertical axis, and a fourth section in which a further two edges of the container are bonded.

8. A device as claimed in claim 1, characterised in that the forming heads (70, 71, 72) are secured to each other by elements (73, 74, 75, 76, 77, 78) which enable them to move relative to each other.

9. A device as claimed in claim 1, characterised in that at least one of the movable forming head elements is provided with a respective lateral stem (79, 80) comprising a counteracting element (81, 82).

10. A device as claimed in claim 1, characterised in that said forming head assembly can be moved translationally by a suitable drive system.

11. A device as claimed in claim 1, characterised in that said initial shaping station comprises at least one nozzle connected to a hot air distribution system.

12. A device as claimed in claim 11, characterised in that said initial shaping station comprises a plurality of nozzles symmetrical about the longitudinal axis of the initial shaping station and connected to a hot air distribution system.

13. A device as claimed in claim 1, characterised in that said initial shaping station comprises vertical elements which interact with said counteracting elements and with the outer forming heads in a rigid manner, and which oblige said heads to approach each other by a vertical movement of said assembly.

14. A device as claimed in claim 1, characterised in that said initial shaping station comprises at least one means for aiding the shaping station comprises at least one means for aiding the shaping of the shaped container and consisting of a pair of plate elements (105, 106) caused to diverge by relative elastic elements (110, 111).

15. A device as claimed in claim 14, characterised in that said shaping aid means is supported on a carriage (109) which can be moved translationally.

16. A device as claimed in claim 1, characterised by comprising a thermowelding station (52) in which vertical walls (18, 19, 20, 21) which bound each adjacent compartment are welded together.

17. A device as claimed in claim 16, characterised in that said thermowelding station comprises arms (112) provided with two grippers (115) pivoted to them and movable between a position in which they are withdrawn from said vertical walls (18, 19, 20, 21), and a position in which they clamp these latter together, nozzles (116) being provided for blowing hot air in order to soften the weld from said thermowelding station.

18. A device as claimed in claim 1, characterised in that said counteracting means comprise sectors **(91*a*, 91*b*, 91*c*, 91*d*) having a surface rounded about a horizontal axis and contributing to the folding of said blank (10) about its preferential creasing lines so as to form compartments by acting on surfaces (9, 17, 22)** which when positioned vertically bound said compartments.

* * * * *